US006719276B1

(12) United States Patent
Bush

(10) Patent No.: US 6,719,276 B1
(45) Date of Patent: Apr. 13, 2004

(54) LANDSCAPE FENCE COVER

(76) Inventor: Jeffery Bush, 2983 E. Stewart Rd., Midland, MI (US) 48640

( * ) Notice: Subject to any disclaimer, the term of this patent is extended or adjusted under 35 U.S.C. 154(b) by 0 days.

(21) Appl. No.: 10/261,901

(22) Filed: Sep. 30, 2002

(51) Int. Cl.[7] ..... E04H 17/00
(52) U.S. Cl. ..... 256/1; 256/32; 40/606.03; 40/611.01
(58) Field of Search ..... 40/606.03, 611.01, 40/617; 256/1, 32, 59, 19

(56) References Cited

U.S. PATENT DOCUMENTS 4,525,946 A * 7/1985 Olson ..... 40/514
4,907,783 A * 3/1990 Fisk et al. ..... 256/32
5,039,065 A * 8/1991 Denton ..... 256/1
5,328,156 A * 7/1994 Hoke ..... 256/32
6,272,779 B1 * 8/2001 Seiber et al. ..... 40/607.14

* cited by examiner

*Primary Examiner*—John R. Cottingham
(74) *Attorney, Agent, or Firm*—McKellar Stevens, PLLC; Robert L. McKellar

(57) ABSTRACT

A fence cover for improving the appearance and function of preexisting fencing that is formed of rigid panels having an outer face provided with aesthetically pleasing color or indicia. The indicia may depict a landscape or simulate other fencing styles.

20 Claims, 6 Drawing Sheets

FIG. 4
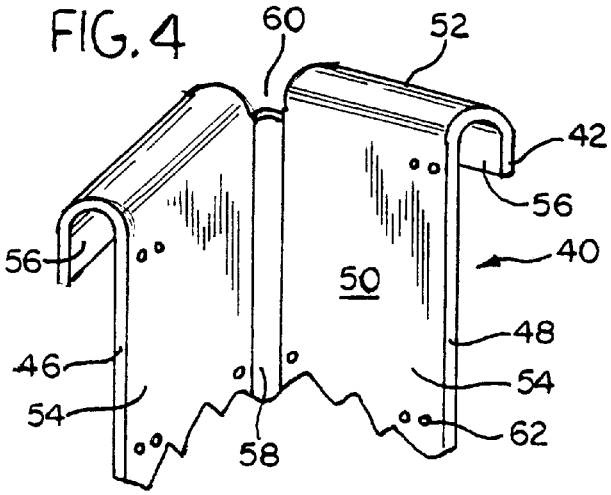
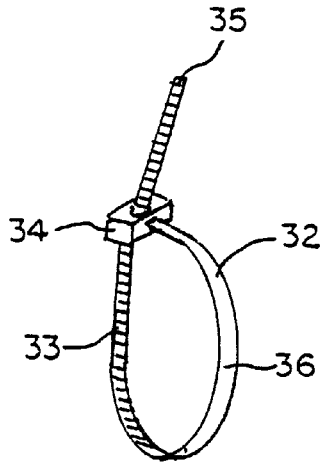
FIG. 7
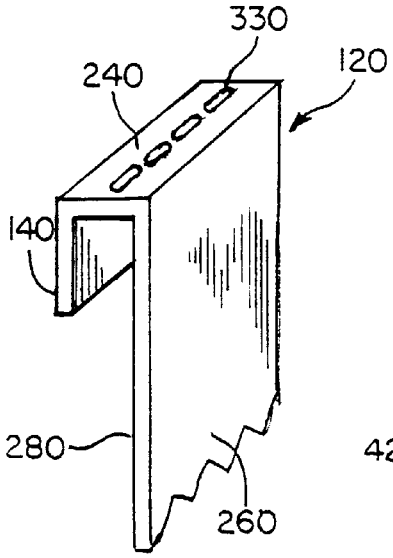
FIG. 5
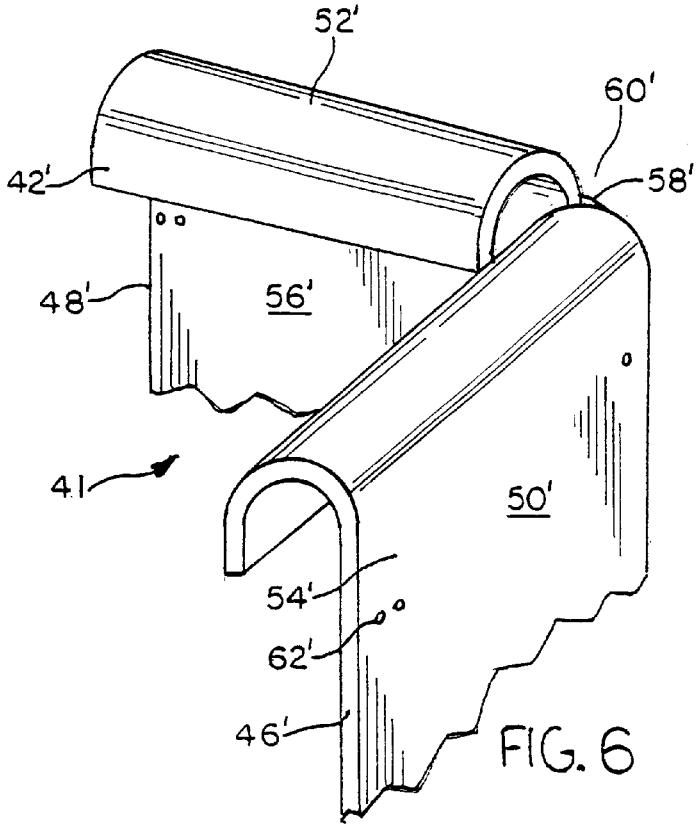
FIG. 6

LANDSCAPE FENCE COVER

BACKGROUND OF THE INVENTION

Fencing is used by businesses and homeowners to create boundaries, protect property, keep children and pets within a safe enclosure, and add ornamentation to existing landscape features. Fencing is manufactured in a great variety of styles and types using a wide selection of materials. Two of the most common types are chain link fence, that consists of a galvanized steel mesh supported by steel pipes, and wood stockade fencing, that consists of wood planks supported by wood posts and framing.

Although these types of fencing are extremely functional and durable, they can also be unattractive. To replace these existing fences with an alternative fence style that is more attractive and perhaps less functional is labor intensive and usually cost prohibitive. Therefore, a need exists for a means to improve the appearance and function of preexisting fencing.

SUMMARY OF THE INVENTION

An innovative landscape fence cover is described herein that improves the appearance and function of preexisting fencing. The landscape fence cover is suspended from the upper edge of the preexisting fence and is formed of multiple panels that are provided with aesthetically pleasing indicia and/or textures. The indicia may depict a landscape such as a seascape or mountain range, may simulate other fencing styles such as wood planks or fieldstone, or may be single, or multi-colored in muted or vibrant colors. Texture may be added to add to the appearance of the indicia. For example, wood grain texture may be added to a simulated wood panel fence. These panels improve the appearance of existing fencing, provide a wind break, and insure privacy.

The panels can be formed in differing widths, heights, and include corner sections to fully cover one side of the preexisting fence, regardless of its size. The top edge of each panel is folded back on itself to form a generally U-shaped hook, that is used to hang the panel from the upper edge of the preexisting fence.

In use, a first panel is suspended from upper edge of the preexisting fence so that it overlies the upper edge, and completely covers a portion of one face of the fence from the upper edge to the ground. Subsequent panels are then suspended and reside generally side-by-side with the first panel except at the adjacent vertical edges. In these regions, the leading vertical edge of subsequent panels overlies the trailing vertical edge of previously suspended panels. In the preferred embodiment, respective adjacent vertical edges overlap each other approximately 6 inches. This overlap insures a uniform appearance to the fence cover and insures the privacy of the user by eliminating spaces between panels.

Each panel is secured to the fence using an attachment means that may be, for example, self-locking plastic ties that pass through the panel to surround the fence support post.

BRIEF DESCRIPTION OF THE DRAWINGS

FIG. 4 is a partial front perspective view of an inside corner section of the fence cover.

FIG. 5 is a partial front perspective view of a second embodiment of the fence cover illustrating a hook portion that is channel shaped in section for use in hanging the fence cover over the square periphery of a plank board fence.

FIG. 6 is a partial front perspective view of an outside corner section of the fence cover.

FIG. 7 is an illustration of one means for securing the body of the fence cover to the underlying fence.

DETAILED DESCRIPTION OF THE INVENTION

Figure 1:
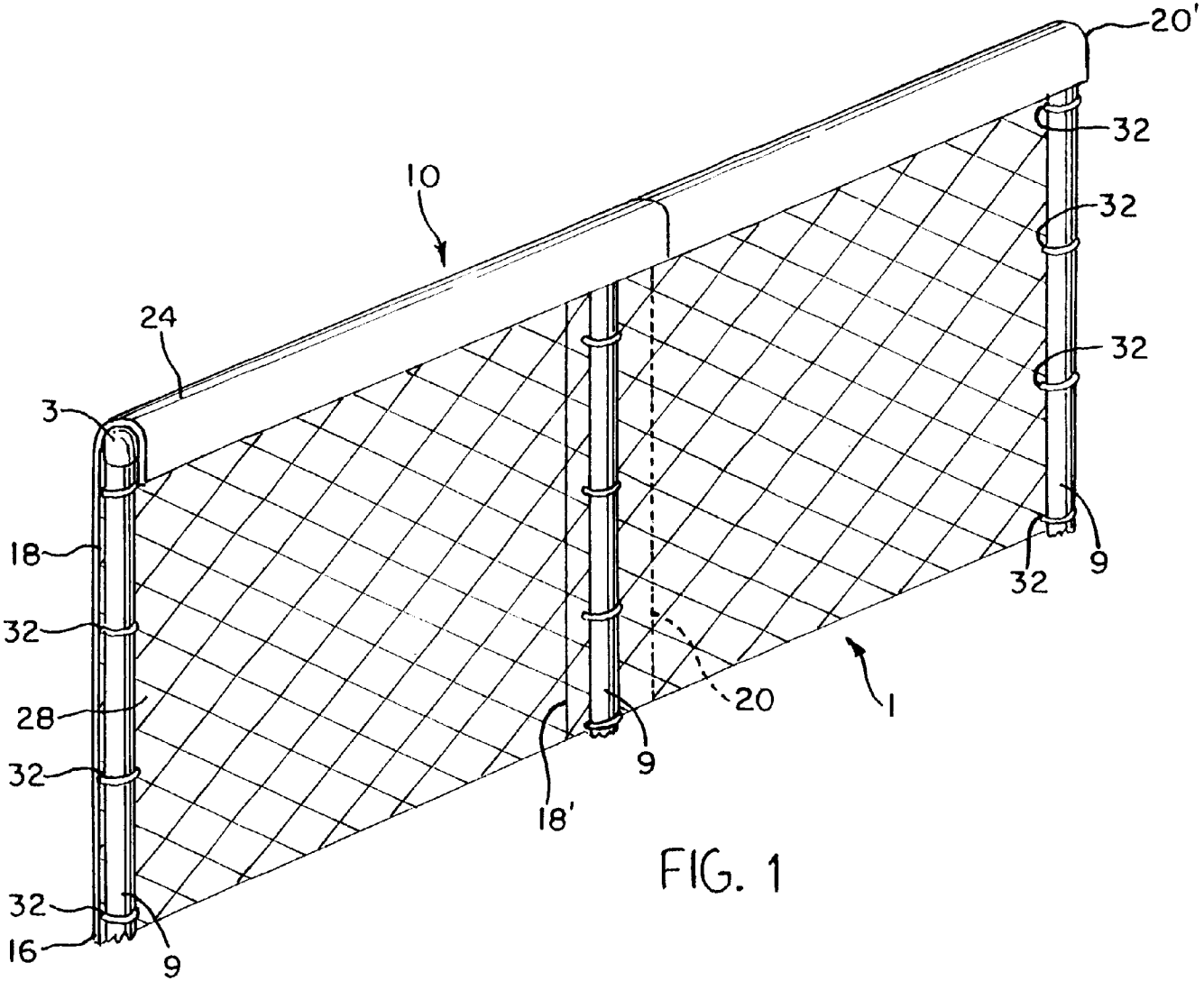
FIG. 1 is a rear perspective, view of the preferred embodiment of the landscape fence cover installed on a chain link fence, illustrating the upper portion of the fence overlying and resting on the top edge of the fence, the overlap of adjacent fence cover sections, and the use of ties to secure the body of the fence cover to the fence poles.
Figure 2:
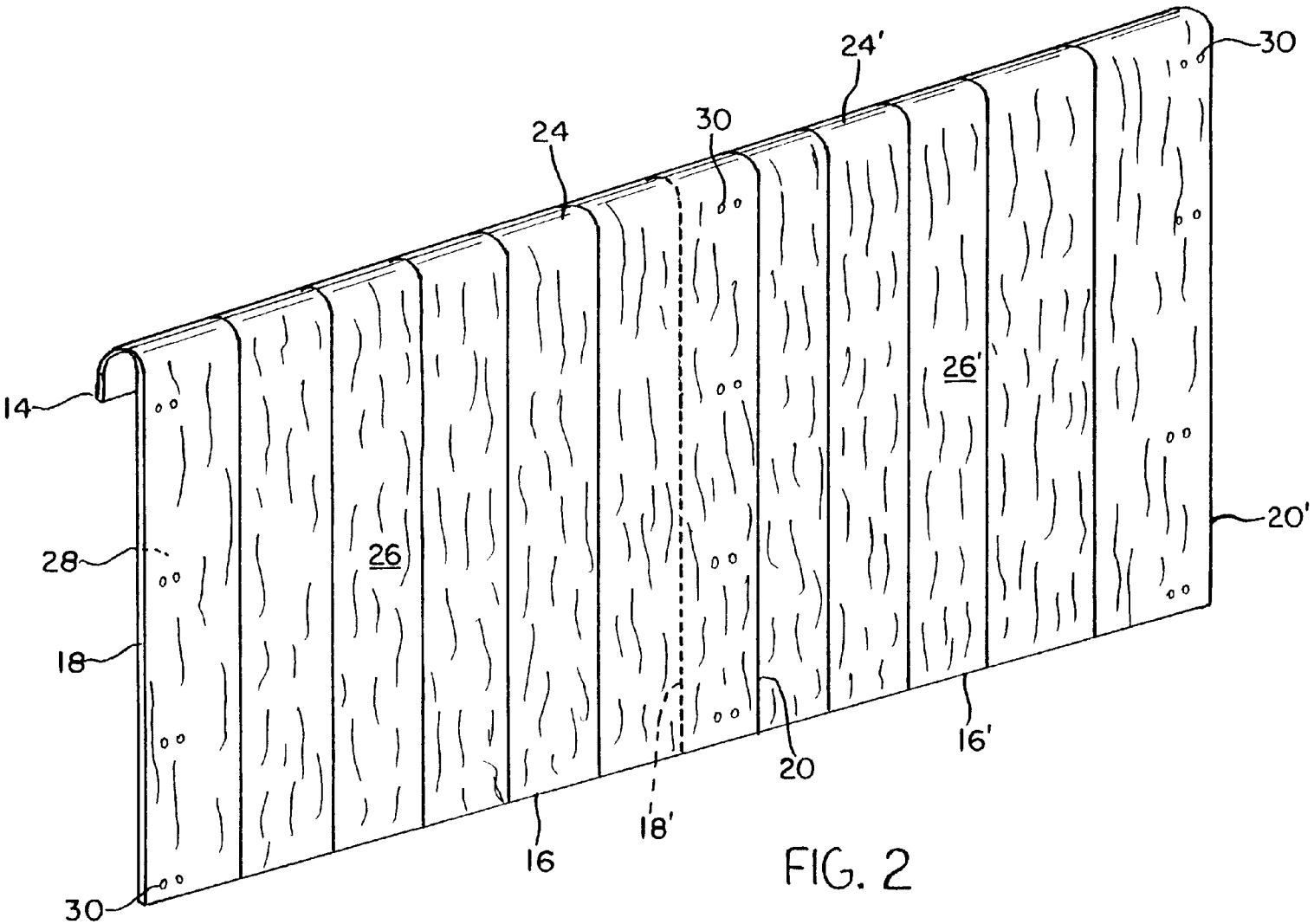
FIG. 2 is a front perspective view of the preferred embodiment of the landscape fence cover shown in FIG. 1, illustrating indicia on the front face that gives the fence cover the appearance of a vertical plank wood fence.
Figure 3:
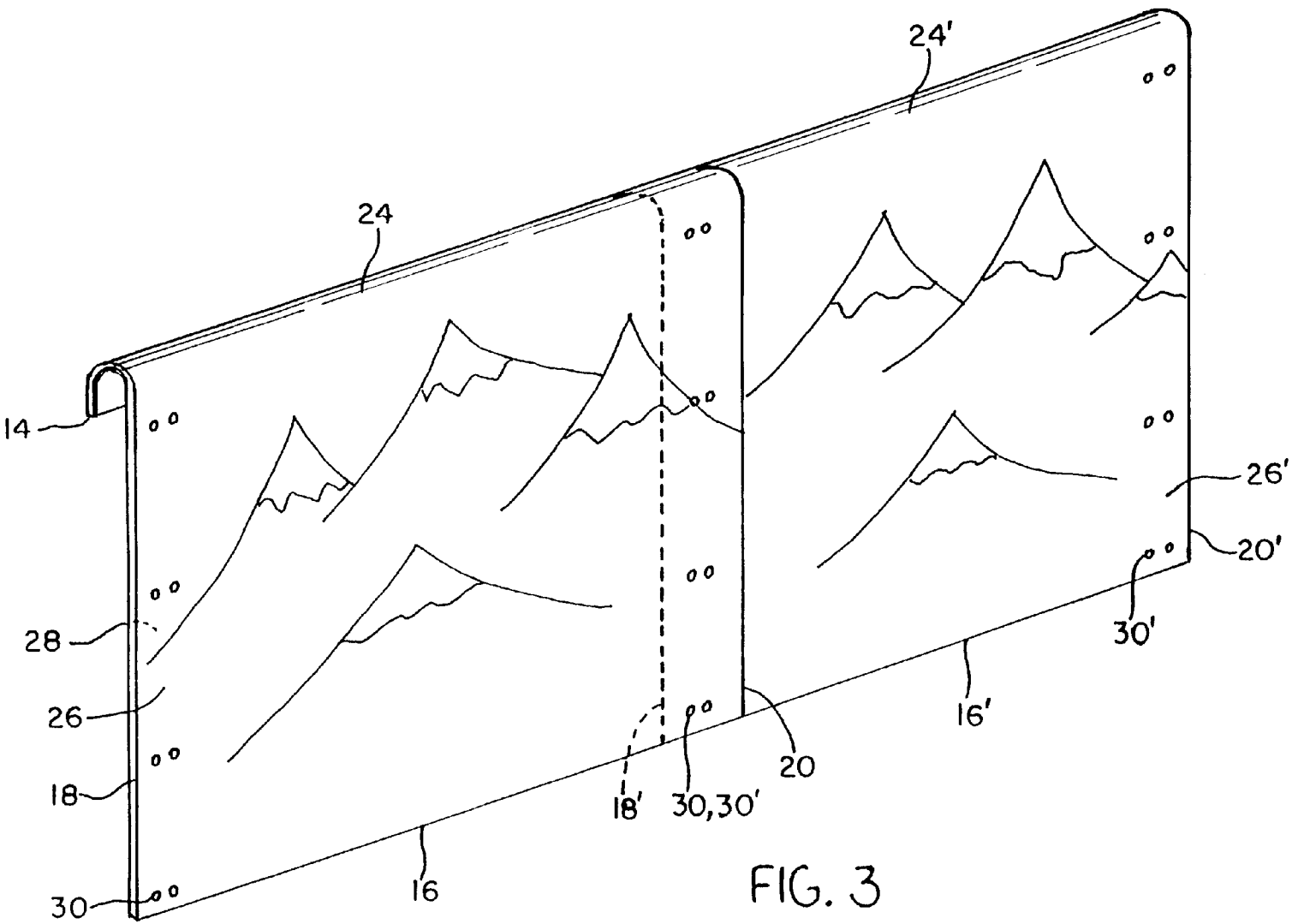
FIG. 3 is a front perspective view of the preferred embodiment of the landscape fence cover shown in FIG. 1, illustrating alternative indicia on the front face that gives the fence cover the appearance of a scenic landscape, including small trees and shrubbery.
Figure 8:
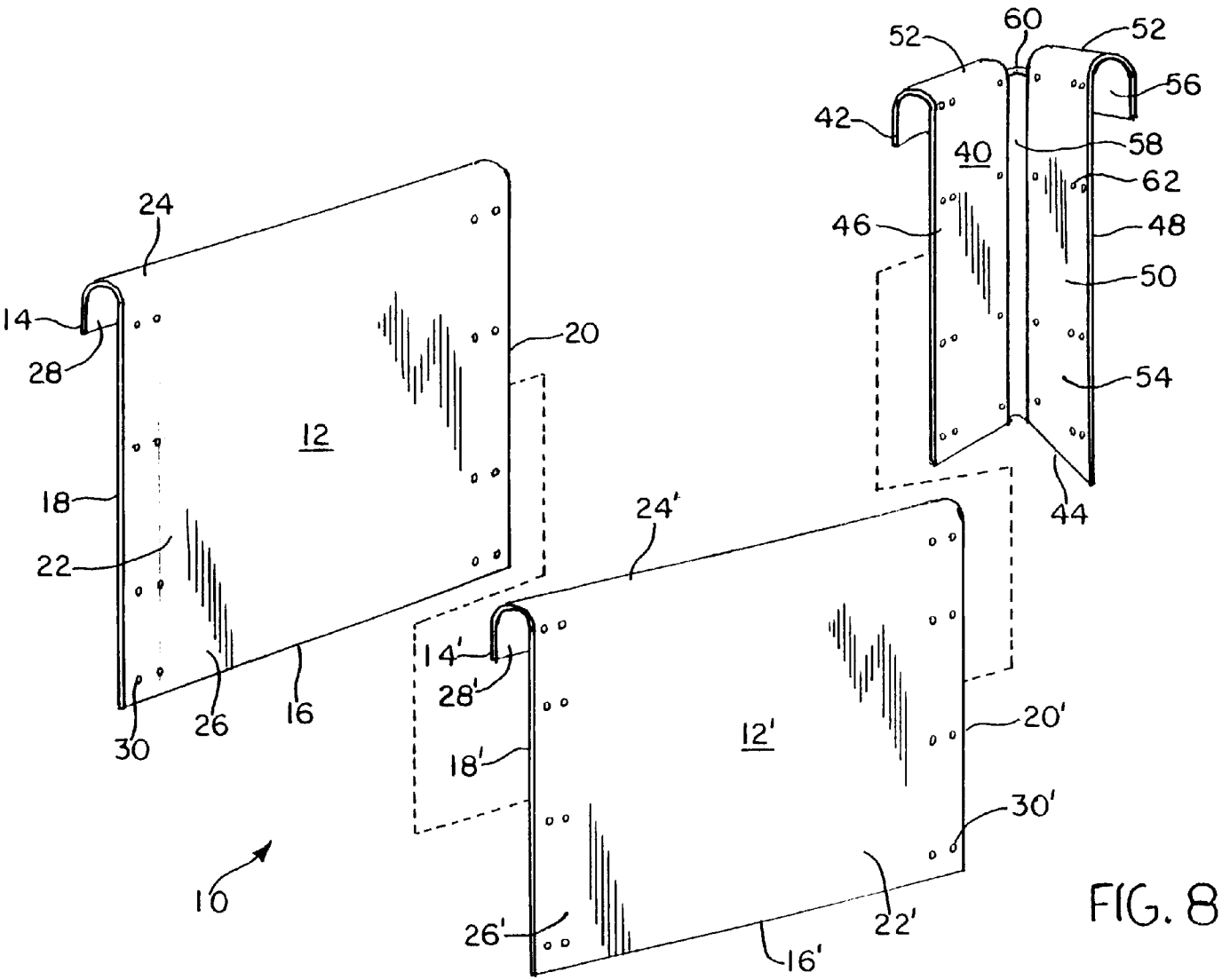
FIG. 8 is an exploded view of a landscape fence cover assembly, including two planar panels and an inner corner panel.

The inventive fence cover 10 will now be described with respect to the figures. Fence cover 10 overlies and confronts the upper edge 3 and one side 5 of a conventional fence 1. Fence 1 is illustrated in the figures as a chain link fence, but fence cover 10 can be used to improve any preexisting fence style. Fence 1 is supported by fence posts 9, and has a first side 5 (FIG. 9) that is to be covered, and an opposing side 7.

Fence cover 10 is assembled from multiple panels 12, each panel 12 being formed of thin panels of plastic. Panel 12 is rigid enough to stand on edge without collapsing or pleating, but flexible enough to roll into a large tube. In the preferred embodiment, panel 12 is formed of vinyl panels having an approximate thickness of 3/16 inch. However, it is within the scope of this invention to use alternative materials that can provide similar material properties.

Panel 12 has a front face 26, a rear face 28 that is opposed to the front face and separated from it by the thickness of panel 12. Panel 12 has a top edge 14 and bottom edge 16 that are horizontally oriented, and a first vertical edge 18 and a second vertical edge 20 that are vertically oriented. The body portion 22 is bordered by the top 14, bottom 16, first vertical 18, and second vertical 20 edges, and is defined by front face 26 and rear face 28.

Front face 26 may be provided with aesthetically pleasing indicia and/or textures. The indicia may depict a landscape such as a seascape, a pastoral scene, or mountain range, may simulate other fencing styles such as wood planks or fieldstone, or may be single, or multi-colored in muted or vibrant colors. Texture may be added to add to the appearance of the indicia. For example, wood grain texture may be added to a simulated wood panel fence. These markings, colorings, and textures on front face 26 of panel 12 provide the user with a wide selection of styles and concepts with which to improve the appearance of existing fencing.

In manufacture, top edge 14 is folded back over rear face 28 in the region adjacent to top edge 14 such that top edge 14 overlies but is spaced apart from rear face 28. Fold 24 forms a hook or hanger that extends continuously along the upper portion of panel 12. In use, upper edge 3 of fence 1 is received within fold 24 in the space between top edge 14 and rear face 28 so that panel 12 is suspended from upper edge 3. FIGS. 1–3, 4, and 6 illustrate fold 24 as arcuate in shape to conform to the round shape of the galvanized steel pipe along the upper edge of a chain link fence.

It is within the scope of this invention, however, to form fold 24 in alternative cross-sectional shapes to accommodate various shapes of the upper edges of different style fences. An example of an alternative shape is shown in FIG. 5, where top edge 140 of panel 120 is folded back over rear face 280 to form a fold 240 having a channel-shaped cross section. Panel 120 having channel-shaped fold 240 would be well suited for use on a wood plank fence, or any other fencing having a rectangular upper edge 3. Panels 120 used on wood fencing are provided with elongate slots 330, positioned along and in alignment with fold 240, that allows panels 120 to compensate for expansion and contraction of the underlying wood structure. Preferably, slots 330 are approximately 1 inch in length, ¼ inch in width, and are provided with 6 inch spacing.

Panel 12 is suspended from upper edge 3 of fence 1 so that it overlies the upper edge 3, and completely covers a portion one face 5 from upper edge 3 to the ground. Additional panels 12' are then placed laterally adjacent to previously placed panel to cover additional portions of fence 1. Subsequent panels 12' reside generally side-by-side with previously suspended panels except at the adjacent vertical edges. In these regions, that the leading vertical edge of subsequent panels (for example, the first vertical edge 18' of additional panel 12') overlies the trailing vertical edge of the previously suspended panels (for example, second vertical edge 20 of panel 12). In the preferred embodiment, respective adjacent vertical edges overlap each other approximately 6 inches. This overlap insures a uniform appearance to fence cover 10 and insures the privacy of the user by eliminating spaces between panels.

Each panel 12 is secured to fence 1 using self-locking plastic ties 32 (FIG. 7). These ties are well known commercially and are formed of a single elongate thin, flat, strip of plastic having an eye 34 at one end. One face of the plastic strip is provided with a series of cross ridges 33 that interlock with the interior of the eye 34 such that when the leading end 35 is inserted into eye 34 to form a closed loop 36, leading end can move in one direction through eye 34. This action causes loop 36 to contract to a desired diameter, and the strip cannot be withdrawn from eye 34.

Each panel 12 is provided with at least one, but preferably several, through hole pairs 30 placed along the first 18 and second 20 vertical edges. Leading end 35 of tie 32 is laced through each hole of the through hole pair 30 and around a portion of the fence 1, inserted in eye 34, and then tightened. In this manner, panel 12 is securely fixed to fence 1. Preferably, tie 32 is wrapped around fence post 9, but also may be secured to chain links or wood panels. Additional ties 32 are placed along the overlapped portion of vertical edges (for example, between 18' and 20, FIG. 3).

In the preferred embodiment, through hole pairs 30 are formed in panel 12 during assembly on fence 1. Through hole pairs 30 can easily be drilled, and forming them at assembly insures alignment at fence post 9. It also insures that the through hole pair 30 of the trailing edge of a panel 12 is aligned with the through hole pair 30' of the leading edge of an overlapping panel 12'. It is within the scope of the invention, however, to form panels 12, 12' having predrilled through hole pairs 30, 30'.

Angled panels 40, 41 are provided for use in covering corner portions of fence 1. Inner corner panel 40 (FIG. 4) is formed having top edge 42, bottom edge 44 (not shown), first vertical edge 46 and second vertical edge 48. Body 50 is surrounded by these respective edges 42, 44, 46, and 48, and is provided with front face 54 and rear face 56. As in panel 12, top edge 42 of inner corner panel 40 is folded back over rear face 56 in the region adjacent to top edge 42 such that top edge 42 overlies but is spaced apart from rear face 56. The resulting fold 52 forms a hook or hanger along the upper portion of inner corner panel 40. Inner corner panel 40 is provided with a bend 58 about the vertical centerline such that the portion of front face 54 adjacent to first vertical edge 46 is normal to and forms an interior angle with the portion of front face 54 adjacent to second vertical edge 48. Notch 60 is formed in fold 52, prior to forming bend 58, by removing a portion of the panel along the vertical centerline of inner corner panel 40. This notch prevents fold 52 from deforming in the region of bend 58. Inner corner panel 40 is secured to panels 12 and fence 1 using ties 32 that pass through through hole pairs 62 along first and second vertical edges 46, 48, and about bend 58.

Outer corner panel 41 (FIG. 6) is identical to inner corner panel 40 except for the direction of bending to form bend 58. Outer corner panel 41 is formed having top edge 42', bottom edge 44' (not shown), first vertical edge 46' and second vertical edge 48'. Body 50' is surrounded by these respective edges 42', 44', 46', and 48', and is provided with front face 54' and rear face 56'. As in panel 12, top edge 42' of outer corner panel 41 is folded back over rear face 56' in the region adjacent to top edge 42' such that top edge 42' overlies but is spaced apart from rear face 56'. The resulting fold 52' forms a hook or hanger along the upper portion of outer corner panel 41. Outer corner panel 41 is provided with a bend 58' about the vertical centerline such that the portion of front face 54' adjacent to first vertical edge 46' is normal to and forms an exterior angle with the portion of front face 54' adjacent to second vertical edge 48'. A notch 60' is formed in fold 52', prior to forming bend 58', by removing a portion of the panel along the vertical centerline of outer corner panel 41. Notch 60' prevents fold 52' from deforming in the region of bend 58'. Outer corner panel 41 is secured to panels 12 and fence 1 using ties 32 that pass through through hole pairs 62' along first and second vertical edges 46', 48', and about bend 58'.

In the preferred embodiment, panels 12, inner corner panels 40, and outer corner panels 41 are provided in three heights, 4, 6, and 8 feet, to correspond to the standard heights of conventional fences. Panels 12 are provided in approximate 11 foot lengths, to provide 10 foot of horizontal fence coverage and 6 inches of overlap at each end. Inner and outer corner panels 40, 41 are provided in approximately 14 inch widths so that at least a 6 inch overlap can be provided on each side of bend 58, 58'. It is, however, well within the scope of this invention to provide panels 12, inner corner panels 40, and outer corner panels 41 having different heights and widths to accommodate the requirements of a specific fence conversion.

A second embodiment of the landscape fence cover 500 (FIG.9) is provided that allows the user to decorate both sides of a preexisting fence. Fence cover 500 is suspended from upper edge 3 of the preexisting fence 1 so that it overlies upper edge 3 and completely covers both faces 5, 7 of fence 1.

As in the first embodiment, second embodiment fence cover 500 is assembled from multiple panels 512, each panel 512 being formed of thin panels of plastic. Panel 512 has an outer face 526, an inner face 528 that is opposed to the front face and separated from it by the thickness of panel 512. Panel 512 has a front bottom edge 516 and rear bottom edge 517 that are horizontally oriented, and a first vertical edge 518 and a second vertical edge 520 (not shown) that are vertically oriented. The body portion 522 (not shown) is bordered by the front bottom edge 516, rear bottom edge 517, first vertical edge 518, and second vertical edge 520, and is defined by outer face 526 and inner face 528.

In manufacture, panel 512 is folded about a horizontal midline such that front bottom edge 516 is folded back over rear bottom edge 517, and such that the portion of inner face 528 adjacent to front bottom edge 516 faces a portion of inner face 528 adjacent to rear bottom edge 517. Fold 524 forms a hook or hanger that extends continuously along the midline of panel 512. In use, upper edge 3 of fence 1 is received within fold 524 so that panel 512 is suspended from upper edge 3 and so that inner face 528 confronts fence 1.

Outer face 526 may be provided with aesthetically pleasing indicia and/or textures os as to improve the appearance of both sides 5,7 of fence 1. As in the first embodiment fence cover 10, the indicia may depict a landscape such as a seascape, a pastoral scene, or mountain range, may simulate other fencing styles such as wood planks or fieldstone, or may be single-or multi-colored in muted or vibrant colors. Texture may be added to improve the appearance of the indicia. For example, wood grain texture may be added to a simulated wood panel fence. These markings, colorings, and textures on outer face 526 of panel 512 provide the user with a wide selection of styles and concepts with which to improve the appearance of both side of existing fencing.

Figure 9:
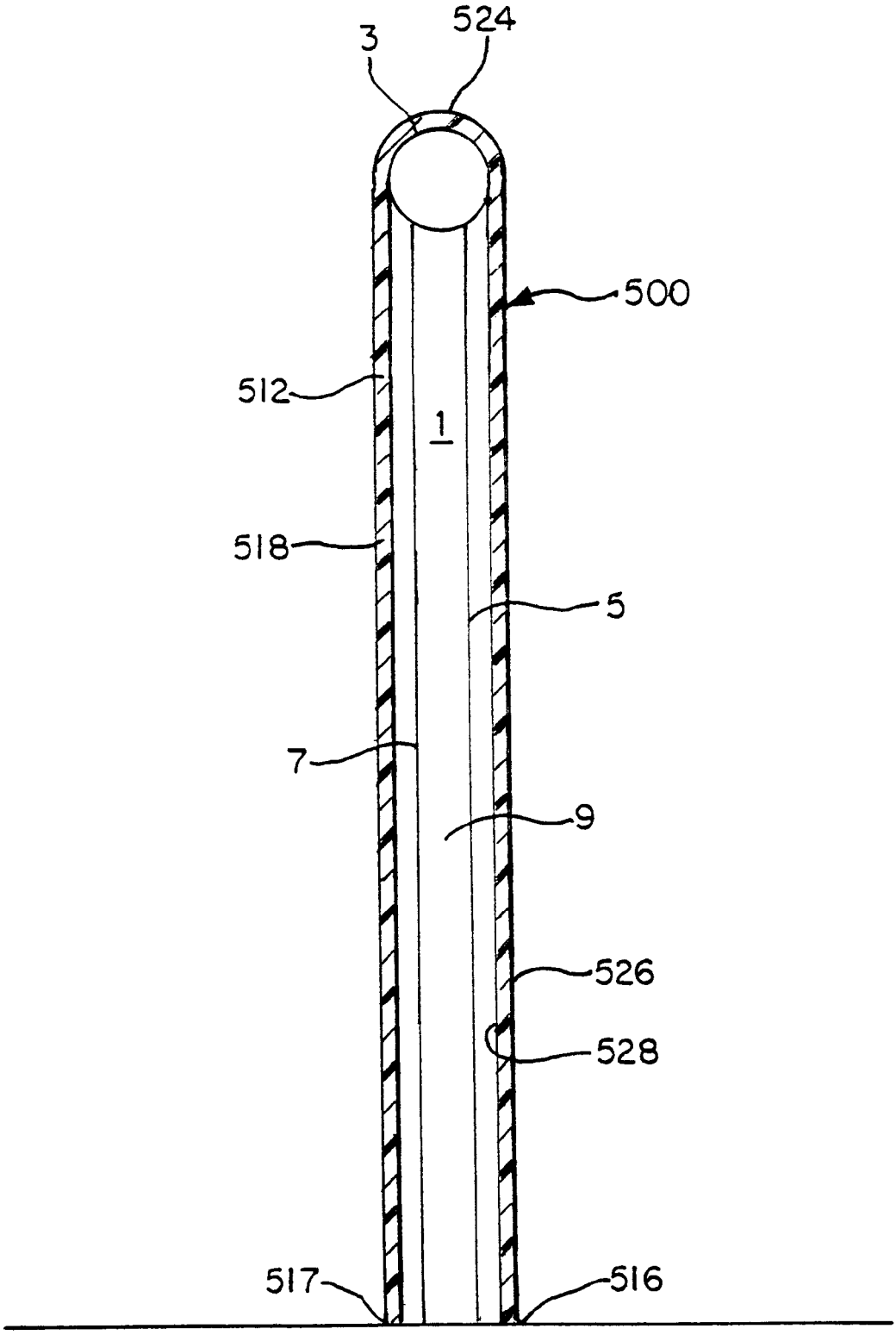
FIG. 9 is a side sectional view of a second embodiment of the fence cover illustrating a panel that completely covers both the front and rear side of the preexisting fence.

FIG. 9 illustrates fold 524 as arcuate in shape to conform to the round shape of the galvanized steel pipe along the upper edge of a chain link fence. It is within the scope of this invention, however, to form fold 524 in alternative cross-sectional shapes to accommodate various shapes of the upper edges of different style fences.

Multiple panels 512 are assembled together to form the complete fence cover, as discussed above for the first embodiment. However, since fence cover 500 is suspended from upper edge 3 of the preexisting fence and extends to the ground on both sides of the fence, it is self-supporting and the need for ties 32 and associated through hole pairs 62 may be eliminated.

That which is claimed is:

1. A landscape fence cover for modifying the appearance and function of a fence, the fence comprising a lower edge which lies adjacent to and confronts the ground, the fence comprising an upper edge which generally overlies the lower edge and is distant from the ground, the fence cover comprising at least one rigid panel;

the at least one panel comprising a front face, a rear face opposed to said front face, a top edge, and a bottom edge;

wherein the at least one panel is provided with a fold such that the top edge overlies the rear face, the fold forming a hook for hanging the fence cover on the upper edge of the fence.

2. The landscape fence cover of claim 1 wherein the front face is provided with decorative indicia.

3. The landscape fence cover of claim 2 wherein the fold is along a line adjacent to the top edge.

4. The landscape fence cover of claim 2 wherein the fold is along a midline between the top edge and the bottom edge.

5. The landscape fence cover of claim 2 wherein the fold is arcuate in cross section.

6. The landscape fence cover of claim 2 wherein the fold is a channel in cross section.

7. The landscape fence cover of claim 1 wherein the at least one panel is secured to the fence using securing means;

the securing means being located on the fence cover at at least one position, the at least one position being distant from the fold.

8. The landscape fence cover of claim 7 wherein the securing means comprises a self-locking plastic tie; the at least one panel being provided with at least one through hole pair sized and spaced to allow the self-locking plastic tie to be threaded therethrough.

9. The landscape fence cover of claim 1 wherein the at least one panel comprises a first vertical edge and a second vertical edge, each of the first and second vertical edges extending from the top edge to the bottom edge, the first vertical edge being separated from the second vertical edge by the body of the at least one panel;

the at least one panel comprises a first panel and a second panel;

the fence cover being assembled so that the first vertical edge of the second panel overlies the body of the first panel in the region adjacent to the second vertical edge of the first panel such that a portion of the rear face of the second panel overlies and confronts a portion of the front face of the first panel.

10. The landscape fence cover of claim 9 wherein the first panel and the second panel are secured to the fence using securing means;

the securing means being located on the fence cover at at least one position, the at least one position being distant from the fold, the securing means comprises a self-locking plastic tie; each of the first panel and the second panel being provided with at least one through hole pair sized and spaced to allow the self-locking plastic tie to be threaded therethrough.

11. The landscape fence cover of claim 10 wherein an at least one through hole pair of the second panel overlies and is aligned with an at least one through hole pair of the first panel so that a single self locking plastic tie is threaded concurrently through each respective at least one through hole pair.

12. The landscape fence cover of claim 9 wherein the at least one panel comprises a third panel, the third panel comprising a bend along an axis which lies parallel to the first and second vertical edges so that the body of the third panel adjacent to the first vertical edge extends in a generally normal direction to the body of the third panel adjacent to the second vertical edge.

13. A combination fence and fence cover, wherein the fence comprises a front face, a rear face, an upper edge, and a lower edge, wherein the lower edge is adjacent the ground and upper edge is opposed to the lower edge such that the upper edge generally overlies the lower edge and is distant from the ground, the fence comprising at least one vertical support pole extending upward from the ground and that supports the fence in space;

the fence cover comprises at least one thin rigid panel, the at least one panel comprising a front face, a rear face opposed to said front face, a top edge, a bottom edge, a fold such that the top edge overlies the rear face, the fold forming a hook for hanging the fence cover on the upper edge of the fence so that the rear face of the fence cover overlies and confronts the fence, a first vertical edge, a second vertical edge, each of the first and second vertical edges extending from the top edge to the bottom edge, the first vertical edge being separated from the second vertical edge by the body of the at least one panel; the at least one panel comprises a first panel and a second panel; the fence cover being assembled on the fence so that the upper edge of the fence is received within the fold of each respective first and second panels such that each respective first and second panel hangs from the upper edge of the fence, the first vertical edge of the second panel overlies the body of the first panel in the region adjacent to the second vertical edge of the first panel such that a portion of the rear face of the second panel overlies and confronts a portion of the front face of the first panel.

14. The combination fence and fence cover of claim 13 wherein the fence cover comprises securement means for securing each of the at least one panels to the fence.

15. The combination fence and fence cover of claim 14 wherein the securement means comprises a self-locking plastic tie;

each of the first panel and the second panel being provided with at least one through hole pair;

the at least one through hole pair being sized and spaced to allow the self-locking plastic tie to be threaded therethrough;

an at least one through hole pair of the second panel overlies and is aligned with an at least one through hole pair of the first panel so that a single self locking plastic tie is threaded concurrently through each respective at least one through hole pair;

the respective aligned through hole pairs being located in horizontal alignment with the support post of the fence such that in use, the self locking plastic tie encircles the support post and passes through the respective aligned through hole pairs so as to securely fasten the fence cover to the fence.

16. A fence conversion assembly for improving the appearance and function of a preexisting fence structure, the preexisting fence structure comprising an upper edge which is distant from the ground, the preexisting fence structure comprising a lower edge which is opposed to the upper edge and is adjacent the ground, the fence conversion assembly comprising a plurality of rigid panels, the panels being generally planar except along an upper edge, the panels being provided with a continuous hook portion, the hook portion formed by folding the upper edge of the rigid panel back upon itself, the hook portion being used to suspend the plurality of rigid panels from the upper edge surface of the preexisting fence structure.

17. The fence conversion assembly of claim 16 wherein the rigid panels fully and completely overlie and confront one face and an upper edge surface of the preexisting fence structure;

the rigid panels being positioned on the preexisting fence structure such that a first panel is suspended from the upper edge surface of the preexisting fence structure, and then subsequent panels are suspended and placed laterally adjacent to the previously placed panel such that subsequent panels reside generally side by side with previously suspended panels and such that the leading lateral edge of subsequent panels overlie the trailing lateral edge of the previously suspended panels.

18. The fence conversion assembly of claim 17 wherein the rigid panels provided with decorative indicia.

19. The fence conversion assembly of claim 18 wherein rigid panels are fixed to the preexisting fence structure using securing means;

the securing means being located on each rigid panel at at least one position, the at least one position being distant from the hook portion.

20. The fence conversion assembly of claim 19 wherein the securing means comprises a self-locking plastic tie; each rigid panel being provided with at least one through hole pair sized and spaced to allow the self-locking plastic tie to be threaded therethrough.

* * * * *